US007588481B2

(12) United States Patent
Murai et al.

(10) Patent No.: US 7,588,481 B2
(45) Date of Patent: Sep. 15, 2009

(54) WAFER POLISHING METHOD AND POLISHED WAFER

(75) Inventors: Toshinari Murai, Joetsu (JP); Yukio Shibano, Joetsu (JP)

(73) Assignee: Shin-Etsu Chemical Co., Ltd., Tokyo (JP)

( * ) Notice: Subject to any disclaimer, the term of this patent is extended or adjusted under 35 U.S.C. 154(b) by 0 days.

(21) Appl. No.: 11/468,570

(22) Filed: Aug. 30, 2006

(65) Prior Publication Data

US 2007/0045232 A1 Mar. 1, 2007

(30) Foreign Application Priority Data

Aug. 31, 2005 (JP) ..... 2005-251026

(51) Int. Cl.
*B24B 7/19* (2006.01)
*B24B 7/30* (2006.01)
*B24B 19/00* (2006.01)

(52) U.S. Cl. ..... 451/41; 451/460

(58) Field of Classification Search ..... 451/41; 438/455–460

See application file for complete search history.

(56) References Cited

U.S. PATENT DOCUMENTS 4,466,852 A * 8/1984 Beltz et al. ..... 156/344
4,512,113 A * 4/1985 Budinger ..... 451/397
5,267,418 A * 12/1993 Currie et al. ..... 451/364
5,685,766 A * 11/1997 Mattingly et al. ..... 451/36
5,906,532 A 5/1999 Nakajima et al.
6,439,965 B1 * 8/2002 Ichino et al. ..... 451/36
6,666,752 B1 * 12/2003 Yamamoto et al. ..... 451/41

FOREIGN PATENT DOCUMENTS

JP 58-129658 9/1983
JP 62-297064 A 12/1987
JP 63-93562 A 4/1988
JP 2-098926 A 4/1990
JP 11-309665 A 11/1999

OTHER PUBLICATIONS

European Search Report dated Oct. 25, 2006 issued in corresponding European Application No. EP 06 25 4557.

* cited by examiner

*Primary Examiner*—Bryan R Muller
(74) *Attorney, Agent, or Firm*—Westerman, Hattori, Daniels & Adrian, LLP.

(57) ABSTRACT

A wafer substrate is polished by disposing the wafer substrate between an abrasive cloth on a polishing platen and a plate, and relatively rotating the polishing platen and the plate for mirror polishing the surface of the wafer substrate with the abrasive cloth. A liquid is fed onto the plate side surface of the wafer substrate so that the wafer substrate is directly held to the plate by the adsorption force of the liquid, while performing the mirror polishing.

7 Claims, 2 Drawing Sheets

WAFER POLISHING METHOD AND POLISHED WAFER

CROSS-REFERENCE TO RELATED APPLICATION

This non-provisional application claims priority under 35 U.S.C. §119(a) on Patent Application No. 2005-251026 filed in Japan on Aug. 31, 2005, the entire contents of which are hereby incorporated by reference.

TECHNICAL FIELD

This invention relates to a method for mirror polishing wafers, typically lithium tantalate single crystal wafers for use in surface acoustic wave (often abbreviated as SAW) filters.

BACKGROUND ART

In the mobile communications field including PHS and mobile phones, piezoelectric oxide single crystal wafers of lithium tantalate, lithium niobate, quartz, lithium tetraborate, langasite or the like are utilized as substrates of surface acoustic wave devices.

The SAW device includes a piezoelectric oxide single crystal wafer as a substrate and interdigital electrodes deposited on one major surface of the substrate to provide a transducer. Since the device is constructed such that the transducer receives and excites surface acoustic waves, the transducer-forming surface of the single crystal wafer must be mirror polished. If the back surface of the single crystal wafer is similarly mirror polished, the transducer receives and excites unnecessary waves (or interference waves) such as bulk waves at the same time as it receives and excites surface acoustic waves, incurring spurious disturbance in frequency response. Then, single crystal wafers for SAW devices are roughened on their back surface by lapping or honing with coarse abrasive grains.

Specifically, these wafers are traditionally fabricated as follows. A single crystal ingot is first prepared by art-recognized methods such as Czochralski method. Using an inner diameter slicing or wire saw, the ingot is cut into a disc-shaped wafer, which is lapped on both surfaces to a predetermined thickness. Then only one surface of the wafer is mirror polished by an abrasive tool, followed by cleaning.

In unison with the recent trend that equipment such as PHS and mobile phones are reduced in size and profile, SAW devices built therein are also reduced in profile. There thus exists an urgent requirement to reduce the thickness of piezoelectric oxide single crystal wafers for use in SAW filters or the like.

In the case of lithium tantalate single crystal wafers for use in SAW filters or the like, for example, wafers of 350 microns thick are common at the present while efforts have been initiated to produce thinner wafers with a thickness of around 250 microns.

In the SAW-utilizing devices described above, the necessary thickness of piezoelectric oxide single crystal is computed to be 10 times the wavelength on theory. This, combined with the state-of-the-art, suggests that a thickness of around 50 microns is sufficient. While piezoelectric oxide single crystal wafers having a thickness of 350 microns are supplied, some device manufacturers have started implementing a process of forming a metal electrode pattern on the mirror finish surface of such a thick wafer by photolithography or the like, and finally removing an unnecessary portion from the wafer back side by a surface grinding technique or the like.

Under such circumstances, if a wafer manufacturer supplies thinner piezoelectric oxide single crystal wafers, they are expected to contribute to a reduction of process steps on the device manufacturer side. However, as piezoelectric oxide single crystal wafers become thinner, they become lower in mechanical strength and more susceptible to failure during the wafer manufacturing process, so that the manufacturing yield can be reduced.

In particular, the process of working piezoelectric oxide single crystal wafers for use in SAW devices has the following problem. While a relatively thick disc-shaped wafer is furnished by cutting, it must be worked to the target thickness by post-steps of lapping and mirror polishing. An increased risk of wafer failure resulting from reduced mechanical strength is of concern.

As discussed above, when piezoelectric oxide single crystal wafers are used as SAW filters, the transducer-forming surface of the wafer must be mirror polished because the transducer receives and excites surface acoustic waves. On the other hand, the back surface of the wafer must be roughened by lapping or honing with coarse abrasive grains in order to exclude unnecessary waves (or interference waves) such as bulk waves which are received and excited at the same time as are surface acoustic waves.

Prior Art 1: JU-A 58-129658
Prior Art 2: JP-A 2-98926
Prior Art 3: JP-A 62-297064
Prior Art 4: JP-A 63-93562

DISCLOSURE OF THE INVENTION

In the prior art process of working piezoelectric oxide single crystal wafers for use in SAW devices, an attempt to produce thin wafers which are as thin as 100 microns or less encounters the difficulty of producing such wafers in high yields because of reduced mechanical strength of thin wafers themselves.

In the process of working thin piezoelectric oxide single crystal wafers with a thickness of 100 microns or less for use in SAW devices, it is desired to produce in a consistent manner wafers having an improved working accuracy such as high flatness or parallelism equivalent to that of the existing thick piezoelectric oxide single crystal wafers with a thickness of about 350 microns, without the problem of reduced yields resulting from failure during lapping or mirror polishing due to lower mechanical strength of wafers themselves and while maintaining their front and back surface states equivalent to those of the existing thick piezoelectric oxide single crystal wafers with a thickness of about 350 microns.

Accordingly, an object of the present invention is to provide a method for polishing thin wafers, typically piezoelectric oxide single crystal wafers, especially having a thickness equal to or less than 100 μm, which method prevents the wafers from being broken during lapping or mirror polishing due to reduced mechanical strength, maintains the manufacturing yield equal to that of the existing 350-μm thick wafers, and ensures a working accuracy such as flatness or parallelism equivalent to that of the existing thick wafers. Another object is to provide the wafers polished by the inventive method.

The inventors have discovered that the following method is effective in the step of polishing a thin wafer, typically piezoelectric oxide single crystal wafer, especially having a thickness equal to or less than 100 μm, by lapping or mirror polishing, and that the mechanical strength of a piezoelectric oxide single crystal wafer can be increased by combining it with a support substrate.

One embodiment of the invention is a method for polishing a wafer substrate, comprising the steps of disposing the wafer substrate between an abrasive cloth on a polishing platen and a plate, relatively rotating the polishing platen and the plate for mirror polishing the abrasive cloth side surface of the wafer substrate with the abrasive cloth, and feeding a liquid onto the plate side surface of the wafer substrate so that the wafer substrate is directly held to the plate by the adsorption force of the liquid, while performing the mirror polishing.

The wafer substrate has a diameter of D mm. In a preferred embodiment, a template with a punched hole having a diameter from D mm to D+5.0 mm is secured to the plate, and the wafer substrate is fitted within the punched hole of the template before the wafer substrate is directly held to the plate via the liquid. In a further preferred embodiment, a support substrate having a diameter from D mm to D+2.5 mm is laminated to the wafer substrate before the abrasive cloth side surface of the wafer substrate is mirror polished with the abrasive cloth.

Another embodiment of the invention is a method for polishing a wafer substrate, comprising the steps of disposing a polishing carrier having a punched hole between abrasive cloths on a pair of upper and lower polishing platens, disposing the wafer substrate within the punched hole of the carrier, relatively rotating the polishing platens for mirror polishing the front and back surfaces of the wafer substrate, wherein provided that the wafer substrate has a diameter of D mm and the punched hole of the carrier has a diameter from D mm to D+5.0 mm, a support substrate having a diameter from D mm to D+2.5 mm is laminated to the wafer substrate and the substrate laminate is fitted within the punched hole of the carrier whereby the outer surfaces of the wafer substrate and the support substrate in the laminate are mirror polished.

In a preferred embodiment, the wafer and support substrates are of the same material. More preferably, the wafer and support substrates have polarized surfaces and are laminated together at their identically polarized surfaces.

A wafer worked by the polishing method described above is also provided. The wafer typically comprises a piezoelectric oxide single crystal, which is preferably lithium tantalate. Typically the lithium tantalate single crystal wafer has a thickness of up to 100 μm.

BENEFITS OF THE INVENTION

The method of polishing wafer substrates, typically piezoelectric oxide single crystal wafers according to the invention is successful in producing in a consistent manner wafers with a thickness equal to or less than 100 μm having an improved working accuracy such as high flatness or parallelism equivalent to that of the existing thick piezoelectric oxide single crystal wafers with a thickness of about 350 microns. The invention overcomes the problem of reduced yields resulting from failure during lapping or mirror polishing due to lower mechanical strength of wafers themselves. The resulting wafers maintain their front and back surface states equivalent to those of the existing thick piezoelectric oxide single crystal wafers with a thickness of about 350 microns. When the wafer substrates, typically piezoelectric oxide single crystal wafers are used in devices, they contribute to a reduction of steps in a device manufacturing process because the step of finally machining an unnecessary portion off from the wafer back side by a surface grinding technique or the like can be eliminated.

DESCRIPTION OF THE PREFERRED EMBODIMENTS

Figure 1:
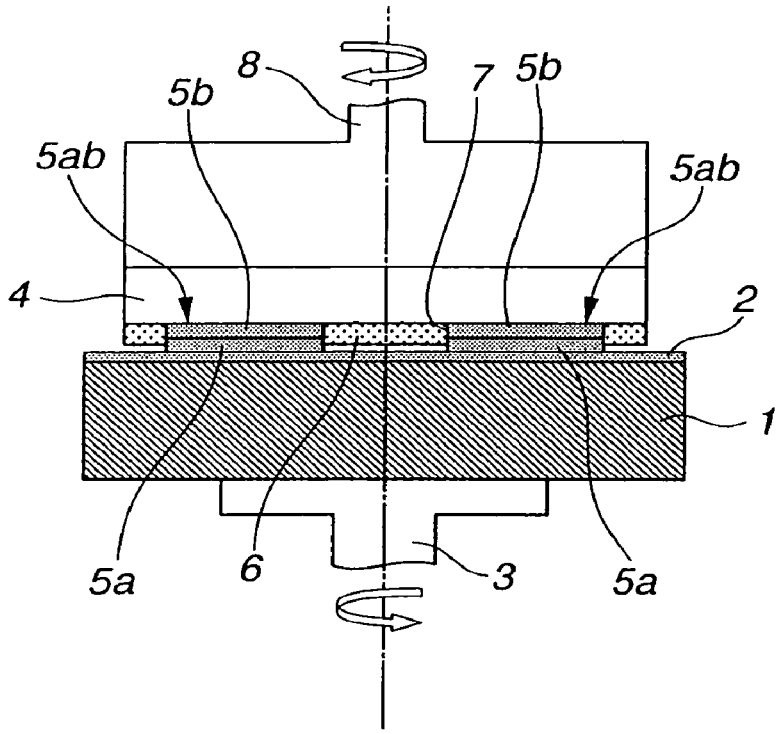
FIG. 1 schematically illustrates a single-side polishing apparatus used in one embodiment of the invention.

One embodiment of the invention is a method for polishing a wafer substrate, comprising the steps of disposing the wafer substrate between an abrasive cloth on a polishing platen and a plate, and relatively rotating the polishing platen and the plate for mirror polishing the abrasive cloth side surface of the wafer substrate with the abrasive cloth. A liquid is fed onto the plate side surface of the wafer substrate. Then the wafer substrate is directly held to the plate by the adsorption force of the liquid while performing the mirror polishing.

Another embodiment of the invention is a method for polishing a wafer substrate, comprising the steps of disposing the wafer substrate between abrasive cloths on a pair of upper and lower polishing platens, and relatively rotating the polishing platens for mirror polishing the front and back surfaces of the wafer substrate. Provided that the wafer substrate has a diameter of D mm, a polishing carrier having a punched hole having a diameter from D mm to D+5.0 mm is used.

The method of the invention is for polishing a wafer whose back surface has been roughened. That is, the mirror polishing step is performed following the step of roughening the back surface of the wafer substrate. Preferably the wafer substrate (product substrate) and a support substrate are combined or laminated with a wax, pressure-sensitive adhesive or the like to form a substrate laminate. The substrate laminate on its support substrate side is directly held by the plate via the liquid.

The wafer must be held and secured to the plate at any desired position. To this end, preferably a template with a punched hole having a diameter from an identical diameter (identical to the diameter of the substrate laminate) to the identical diameter plus 5.0 mm (that is, from D mm to D+5.0 mm), more preferably a diameter from the identical diameter to the identical diameter plus 2.5 mm, is secured to the plate. The substrate laminate is fitted within the punched hole of the template and in this state, the substrate laminate is directly held by the plate via the liquid.

Also the method of the invention is for polishing a piezoelectric oxide single crystal wafer whose back surface has been roughened. That is, the mirror polishing step is performed following the step of roughening the back surface of the wafer substrate. Preferably the wafer substrate (product substrate) and a support substrate are combined or laminated with a wax, pressure-sensitive adhesive or the like to form a substrate laminate. The substrate laminate is disposed between abrasive cloths on a pair of upper and lower polishing platens. The polishing platens are relatively rotated for mirror polishing the upper and lower surfaces of the substrate laminate with the abrasive cloths.

In one preferred embodiment of the wafer polishing method of the invention, the substrate laminate disposed between abrasive cloths on a pair of upper and lower polishing platens is subjected to planetary motion. To this end, preferably a polishing carrier with a punched hole having a diameter from an identical diameter (identical to the diameter of the substrate laminate) to the identical diameter plus 5.0 mm (that is, from D mm to D+5.0 mm), more preferably a diameter from the identical diameter to the identical diameter plus 2.5 mm, is used.

The support substrate used herein may be of any material as long as it has a diameter identical to or more than the diameter of the wafer substrate (product substrate). When the number of support substrates loaded on the polishing apparatus is considered, the support substrate should preferably have a diameter from the identical diameter (identical to the diameter of the wafer substrate) to the identical diameter plus 2.5 mm, more preferably a diameter from the identical diameter to the identical diameter plus 1.0 mm. No particular limit is imposed on the thickness of the support substrate. When the mechanical strength of the substrate laminate is considered, the support substrate should preferably be thick enough and may typically be formed to a thickness of 0.1 to 30 mm.

Further preferably, the support substrate is made of a material having a coefficient of thermal expansion and a thermal expansion behavior similar to the wafer substrate because the wafer substrate can warp when heat treatment is involved in the laminating step. The support substrate and the wafer substrate are preferably laminated so that they develop thermal expansion behavior in opposite directions. Specifically, a support substrate of the same material as the wafer substrate (product substrate) is furnished, and the substrates are preferably laminated with their identically polarized surfaces in contiguous contact. This lamination offsets the warpage of the substrates.

In the preferred embodiment wherein a support substrate of the same material as the wafer substrate (product substrate) is furnished, and the substrates are laminated with their identically polarized surfaces in contiguous contact so as to offset the warpage of the substrates, the substrate laminate can be polished by a single-side polishing technique whereupon the polished wafer substrate is ready for use as a product substrate. Alternatively, the substrate laminate can be polished by a double-side polishing technique whereupon both the polished wafer and support substrates are ready for use as product substrates.

The lamination of a support substrate to a thin wafer substrate having a thickness equal to or less than 100 μm compensates for a lowering of mechanical strength of the thin wafer substrate and thus avoids a reduction of manufacture yield by failure during the mirror polishing. A choice of wax or pressure-sensitive adhesive between the wafer and support substrates ensures to achieve a working precision such as flatness or parallelism equal to that of the existing 350-μm thick wafers.

It is possible to produce a thin wafer having a thickness equal to or less than 100 μm by cutting an ingot into a relatively thick disc-shaped wafer, lapping the wafer to a thickness equal to that of the existing 350-μm thick wafers, then performing the laminating and polishing steps as described above. Alternatively, the relatively thick disc-shaped wafer as cut, with its surface to be finally mirror polished being inside, is laminated to a support substrate with wax or pressure-sensitive adhesive and then lapped, whereby the wafer back surface is worked to a surface roughness for device characteristics. Thereafter, the wafer substrate (product substrate) is separated from the support substrate, and the wafer substrate, with its roughened back surface being inside, is laminated again to a support substrate with wax or pressure-sensitive adhesive and then mirror polished, whereby the front and back surfaces of the wafer are finally worked to the desired states.

The lamination of a wafer substrate (product substrate) to a support substrate followed by lapping and mirror polishing ensures that wafers with a thickness equal to or less than 100 μm are produced in a consistent manner at an improved working accuracy such as high flatness or parallelism equivalent to that of the existing thick piezoelectric oxide single crystal wafers with a thickness of about 350 microns, while avoiding the problem of reduced yields resulting from failure during lapping or mirror polishing due to lower mechanical strength of thin wafers themselves and while maintaining their front and back surface states equivalent to those of the existing thick piezoelectric oxide single crystal wafers with a thickness of about 350 microns.

Referring to the drawings, the inventive method is described in further detail. Before describing the inventive method, reference is made to FIG. 3 that illustrates an exemplary single-side polishing apparatus used in a prior art wafer manufacturing method. The apparatus includes a polishing platen 1 and an abrasive cloth 2 attached to the surface of the platen 1 to provide a polishing surface. A drive shaft 3 is secured to the lower side of the polishing platen 1. Then, the polishing platen 1 is driven for rotation at any desired rotational speed by a drive system (e.g., motor), not shown, through the shaft 3.

Figure 3:
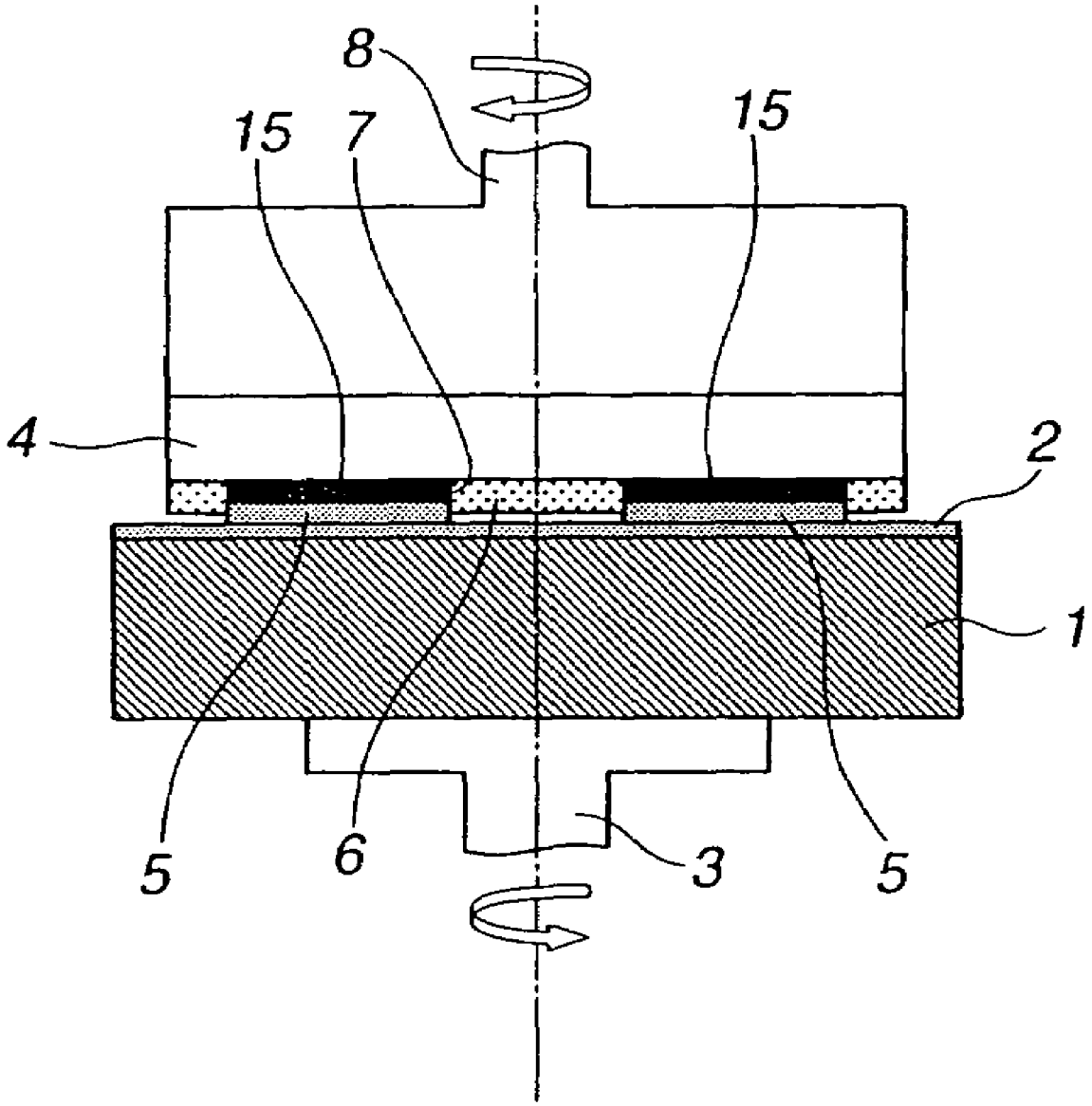
FIG.3 Prior Art
FIG. 3 schematically illustrates a single-side polishing apparatus used in a prior art wafer manufacturing method.

Disposed on the polishing platen 1 (exactly on the abrasive cloth 2) are wafers 5, which are held by a plate 4, for example, a ceramic plate. The wafers 5 are typically piezoelectric oxide single crystal wafers. A variety of means have been proposed for mounting the wafers 5 on the plate 4. For example, the wafers 5 may be adhesively secured to the plate 4 using wax, as described in JU-A 58-129658. Also, a portion of the plate 4 corresponding to the wafers may be provided with a number of suction holes so that the wafers 5 are attracted to the plate 4 by vacuum suction, as described in JP-A 2-98926. Moreover, backings or back pads 15 comprising an adsorbent of polyurethane foam or the like may be secured to the plate 4 using double-side adhesive tape or the like, whereby the wafers 5 are held on the adsorbent through water adsorption, as described in JP-A 62-297064 and JP-A 63-93562. In FIG. 3, numeral 6 is a template and numeral 8 is a drive shaft.

Among these, the technique of adhesively holding wafers directly on a plate via wax is good in working accuracy such as flatness or parallelism, but requires adhesive attachment. When applied to thin wafers with a thickness equal to or less than 100 μm, this adhesive technique raises from the mechanical strength standpoint a problem that the wafers can be broken in subsequently separating from the plate.

The technique of holding wafers directly on a plate by vacuum suction is good in working accuracy such as flatness or parallelism, but has the increased risk that if foreign particles are present between the wafers and the plate, the corresponding portions of the wafers are excessively polished to form dimples. Such dimples become significant particularly when wafers are as thin as 100 μm or less. It is then necessary to prevent foreign particles from being incorporated, which requires strict management of a clean level and automation to minimize man handling, and hence, a vast capital investment therefor.

The technique of suction holding wafers using back pads is free from deficiencies as described above. By changing the thickness of the template, even those wafers which are as thin as 100 μm or less can be polished. However, a varying thickness of the adsorbent made of polyurethane foam can result in polished wafers with reduced working accuracy such as flatness or parallelism. In addition, edge rounding often occurs at the wafer periphery.

Under the above-discussed circumstances, the inventors adopt a technique of holding wafers directly to a plate via a liquid, that is, by the adsorption force of liquid. Referring to FIG. 1, an exemplary single-side polishing apparatus is shown for illustrating the method of polishing thin wafers, typically having a thickness equal to or less than 100 μm. The polishing procedure and mechanism are substantially the same as in FIG. 3. The method starts with wafers (product substrates) 5*a* whose back surface has been roughened. The wafer 5*a* with its back surface inside is combined or laminated to a support substrate 5*b* having a diameter identical to the wafer 5*a* via wax or pressure-sensitive adhesive to form a substrate laminate 5*ab*. These substrate laminates 5*ab* are subjected to single-side polishing as are the wafers 5 shown in FIG. 3. As a result, only one surface of wafers (product substrates) 5*a* is mirror polished.

More particularly, before wafers 5 are mounted to the plate 4, a template 6 of glass-reinforced epoxy having punched holes is secured to the plate 4 with double-side adhesive tape or the like, to define on the plate 4 recesses 7 for holding wafers therein. A liquid such as water is applied to the recesses (punched holes) 7 whereby the wafers 5 are held within the recesses 7 via the liquid, i.e., by the adsorption force of liquid. This holding technique allows the wafers 5 to rotate freely within the recesses 7 in the plate 4 (serving as the wafer holding position) during the mirror-polishing operation, leaving the risk that the wafer back surface is rubbed and flawed. In such a case, as shown in FIG. 1, the wafer (product substrate) 5*a* is laminated to a support substrate 5*b* via wax or pressure-sensitive adhesive to form a substrate laminate 5*ab*. The support substrate side surface of the substrate laminate 5*ab* is held to the plate 4 via a liquid such as water, that is, by the adsorption force of liquid. Then, the polishing operation does not cause rubbing flaws to the back surface of the wafer (product substrate) 5*a* although the support substrate 5*b* is rubbed and flawed. In addition, thin piezoelectric oxide single crystal wafers (product substrates) 5*a* having a thickness equal to or less than 100 μm can be advantageously produced.

In these embodiments, only one surface of a wafer 5, that is, the surface in sliding contact with the abrasive cloth 2 is subjected to mirror polishing. Specifically, the plate 4 having wafers 5 held thereon is driven for rotation by another drive system, not shown, through a drive shaft 8. Abrasives are fed to the abrasive cloth 2 from an abrasive supply, not shown. While feeding abrasives and rotating a polishing platen 1, the plate 4 that forces the wafers 5 against the abrasive cloth 2 is rotated counter to the platen 1. In this way, the surface (in sliding contact with the abrasive cloth 2) of wafers 5 is mirror polished.

After the completion of mirror polishing, the substrate laminate 5*ab* is separated into the wafer (product substrate) 5*a* and the support substrate 5*b*. Since the support substrate 5*b* remains unchanged in thickness, it can be used again as a support substrate. As a matter of course, if the support substrate 5*b* is of the same material as the wafer (product substrate) 5*a*, the subsequent mirror-polishing operation can use that support substrate as a wafer (product substrate) 5*a* whereby the substrate is mirror polished.

Figure 2:
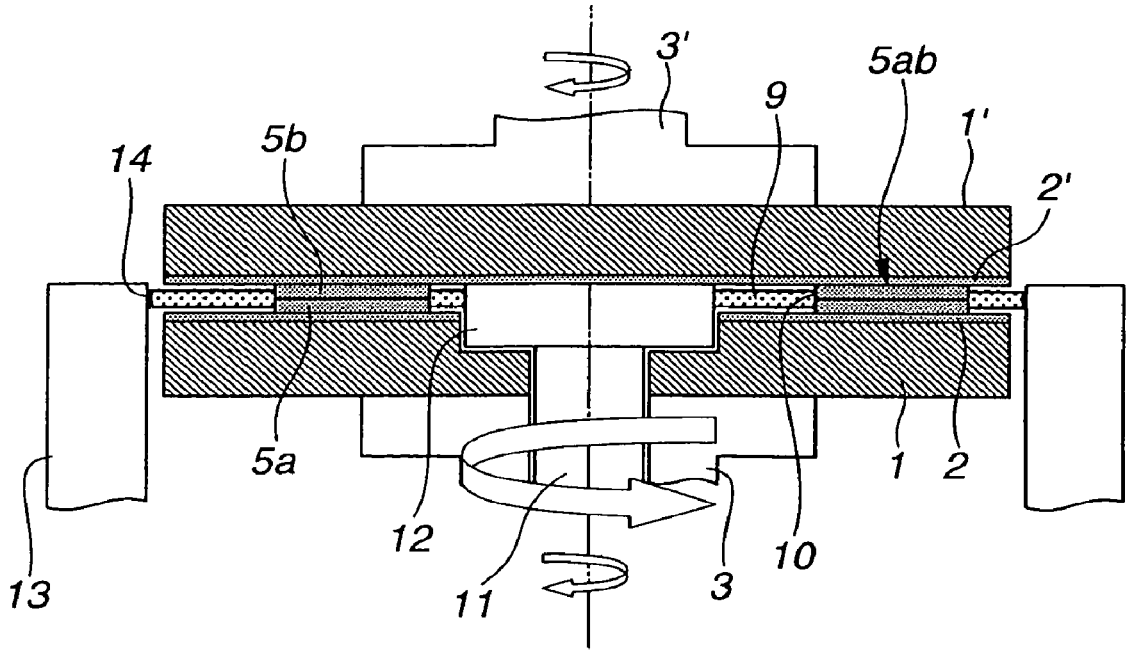
FIG. 2 schematically illustrates a double-side polishing apparatus used in another embodiment of the invention.

FIG. 2 shows an exemplary double-side polishing apparatus for illustrating the method of polishing thin wafers, typically thin piezoelectric oxide single crystal wafers, having a thickness equal to or less than 100 μm. The apparatus includes a pair of lower and upper polishing platens 1 and 1', which are opposed to each other. Abrasive cloths 2 and 2' are attached to the opposed surfaces of the platens 1 and 1', respectively, to present polishing surfaces. Drive shafts 3, 3' are secured to the polishing platens 1, 1', respectively. The polishing platens 1, 1' are rotated in the same or opposite directions at any desired rotational speeds by drive systems (e.g., motors), not shown, via the shafts 3, 3'.

Disposed between the pair of lower and upper platens 1 and 1' (exactly between the abrasive cloths 2 and 2') is a polishing carrier 9 having a hole 10 for receiving therein a substrate laminate 5*ab* each consisting of a wafer (product substrate) 5*a* and a support substrate 5*b*. The carrier 9 at the periphery has a planetary gear in mesh engagement with a sun gear 12 of a central drive shaft 11 and an internal gear 14 of an external member 13, so that when the drive shaft 11 is driven for rotation, the carrier 9 undergoes planetary motion around the drive shaft 11. Again, abrasives are fed to between the abrasive cloths 2 and 2' from an abrasive supply, not shown.

With this construction, the pair of lower and upper platens 1 and 1' apply a predetermined pressure against the substrate laminate 5*ab* fitted in the hole 10 of the polishing carrier 9, and abrasives are fed, and the lower and upper platens 1 and 1' are relatively rotated, and the polishing carrier 9 having the substrate laminate 5*ab* arranged therein is given planetary motion. In this way, one surface (in sliding contact with the abrasive cloth 2) of the wafer (product substrate) 5*a* and one surface (in sliding contact with the abrasive cloth 2') of the support substrate 5*b* are mirror polished.

During the separation step following the mirror polishing step, the substrate laminate 5*ab* is separated into the wafer (product substrate) 5*a* and the support substrate 5*b*. The support substrate 5*b* has a reduced thickness since it has been mirror polished on its one surface. It cannot be reused if its reduced thickness is not enough to compensate for a shortage of mechanical strength of a wafer (product substrate) 5*a*. Otherwise, it can be reused as a support substrate. It is a matter of course that if a support substrate 5*b* is of the same material as a wafer (product substrate) 5*a* and laminated to the wafer 5*a* with their identical polarized surfaces mated, the support substrate 5*b* can be regarded and processed as the same product substrate as the wafer (product substrate) 5*a*.

Now a technique as described in JP-A 11-309665 is considered. In this case, two wafers 5 are laminated via an adsorbent plate to form a sandwich, the sandwich is disposed within a hole 10 of a polishing carrier 9, and the outer surfaces (in sliding contact with abrasive cloths 2, 2') of the two wafers 5 are mirror polished. Since the two wafers are not firmly joined together, they can be rubbed each other. Concerns rise that the inner (or back) surfaces of the wafers are flawed. Since the mechanical strength of wafers is not augmented, this technique is inadequate for the manufacture of thin wafers having a thickness equal to or less than 100 μm.

Next, a process of manufacturing wafers according to embodiments of the invention using single- or double-side polishing apparatus as shown above is described. A single crystal ingot is first prepared by Czochralski method, for example. The ingot is then sliced into disc-shaped wafers. Using a double-side lapping machine, the wafers as sliced are lapped on both surfaces to a desired thickness. The slicing and lapping steps may be conducted as in the prior art.

Then the wafer (product substrate) 5*a* which has been lapped, that is, roughened on both front and back surfaces, with its back surface inside, is laminated to a support substrate 5*b* via wax, pressure-sensitive adhesive or the like. At this point, the support substrate 5*b* should have a diameter from an identical diameter (identical to the diameter D in millimeter of the wafer) to the identical diameter plus 2.5 mm (that is, from D mm to D+2.5 mm), preferably a diameter from the identical diameter to the identical diameter plus 1.0 mm (that is, from D mm to D+1.0 mm).

As long as the support substrate 5*b* has a diameter from D mm to D+2.5 mm, preferably from D mm to D+1.0 mm, the material of which the support substrate 5*b* is made is not particularly limited. When the number of support substrates loaded on the polishing apparatus is considered, the support substrate 5*b* should preferably have an identical diameter to the wafer (product substrate) 5*a*. No particular limit is imposed on the thickness of the support substrate. When the mechanical strength of the substrate laminate is considered, the support substrate 5*b* should preferably be thick enough.

Further preferably, the support substrate 5*b* is made of a material having a coefficient of thermal expansion and a thermal expansion behavior similar to the wafer (product substrate) 5*a* because the wafer 5*a* can warp when heat treatment is involved in the laminating step. The support substrate and the wafer are preferably laminated to form a substrate laminate 5*ab* so that they develop thermal expansion behavior in opposite directions. Specifically, a support substrate 5*b* of the same material as a wafer (product substrate) 5*a* is furnished, and the substrates 5*a* and 5*b* are preferably laminated with their identically polarized surfaces in contiguous contact. This lamination offsets the warpage of the substrates.

In one embodiment, the substrate laminate 5*ab* is then mirror polished using the single-side polishing apparatus shown in FIG. 1. In the mirror polishing step, the substrate laminate 5*ab* is first mounted to the plate 4 so that the support substrate 5*b* contacts the plate 4.

The plate 4 having the substrate laminate 5*ab* mounted thereon is placed above the polishing platen 1 such that the surface to be polished is in contiguous contact with the abrasive cloth 2. The rotating shaft 8 is slowly moved downward until it comes in tight contact with the plate 4. While abrasives are fed onto the platen 1, the plate 4 and the polishing platen 1 are driven for rotation. In this way, the surface (in sliding contact with the abrasive cloth 2) of the wafer (product substrate) 5*a* is mirror polished.

In this regard, since the wafer (product substrate) 5*a* which is as thin as 100 μm or less is laminated to the support substrate 5*b* via wax or pressure-sensitive adhesive, the lamination compensates for a loss of mechanical strength of the wafer (product substrate) 5*a* due to a thickness reduction, allowing the thin wafer to be mirror polished as are the existing 350 μm thick wafers.

In another embodiment, the substrate laminate 5*ab* is mirror polished using the double-side polishing apparatus shown in FIG. 2. In the mirror polishing step, the substrate laminate 5*ab* is first fitted within the hole 10 of the carrier 9.

Then the polishing carrier 9 having the substrate laminate 5*ab* fitted therein is disposed between a pair of lower and upper polishing platens 1 and 1' so that the surfaces to be polished are in contiguous contact with the abrasive cloths 2 and 2'. A predetermined pressure is applied by the pair of lower and upper polishing platens 1 and 1', and abrasives are fed between the abrasive cloths 2 and 2'. In this state, the lower and upper polishing platens 1 and 1' are relatively rotated, and the polishing carrier 9 having the substrate laminate 5*ab* fitted therein is given planetary motion, whereby the surface (in sliding contact with the abrasive cloth 2) of the wafer (product substrate) 5*a* and the surface (in sliding contact with the abrasive cloth 2') of the support substrate 5*b* are mirror polished.

In this regard, since the wafer (product substrate) 5*a* which is as thin as 100 μm or less is laminated to the support substrate 5*b* via wax or pressure-sensitive adhesive, the lamination compensates for a loss of mechanical strength of the wafer (product substrate) 5*a* due to a thickness reduction, allowing the thin wafer to be mirror polished as are the existing 350 μm thick wafers.

When a support substrate 5*b* is of the same material as a wafer (product substrate) 5*a* and laminated to the wafer 5*a* with their identical polarized surfaces mated, the support substrate 5*b* can be regarded and processed as the same product substrate as the wafer (product substrate) 5*a*.

After the completion of mirror polishing, the substrate laminate 5*ab* is separated into the wafer (product substrate) 5*a* and the support substrate 5*b*. Since the wafer (product substrate) 5*a* has a back surface which has not been worked and a front surface which has been mirror polished as are the existing 350-μm thick wafers, it maintains the same front and back surface states as the existing 350-μm thick wafers and possesses an excellent working accuracy such as a high flatness or parallelism comparable to the existing 350-μm thick wafers.

As described above, according to the embodiments of the wafer manufacturing method, even wafers which are as thin as 100 μm or less and hence low in mechanical strength can be lapped or mirror polished without problems associated with low mechanical strength such as breakage during the lapping or mirror polishing operation and a concomitant reduction of manufacturing yield. Wafers possessing an excellent working accuracy such as a high flatness or parallelism can be produced in a consistent manner while maintaining the same front and back surface states as the existing 350-μm thick wafers. The invention greatly contributes to improvements in manufacturing yield and efficiency of SAW devices which are required of size reduction and thus use wafers as thin as 100 μm or less. According to the invention, thin wafers having a thickness down to about 50 μm can be polished.

EXAMPLE

Examples are given below by way of illustration and not by way of limitation.

Example 1

This example relates to a lithium tantalate ($LiTaO_3$) single crystal wafer having a diameter of 100 mm (4 inches). A single crystal ingot was grown by Czochralski method and sliced into wafers using a wire saw. The wafers as sliced were lapped on a double-side lapping machine with appropriate abrasives (loose abrasive grains) to a desired thickness and until the front and back surfaces reached the predetermined roughness state.

Then two wafers lapped as above (having front and back surfaces roughened) were laminated together, with their back surfaces (identical polarized surfaces) inside, using a wax Skyliquid TW-2511 (Nikka Seiko Co., Ltd.). Although a heat treatment is involved in the lamination step, this lamination ensures that the warpage of two wafers is offset because two wafers of the same material develop thermal expansion behavior in opposite directions. The laminate was ready for the subsequent polishing step.

Then the substrate laminate 5*ab* was mirror polished using a single-side polishing apparatus as shown in FIG. 1. Specifically, a template 6 of glass-reinforced epoxy resin having holes (diameter 100.8 mm) punched out was secured to a ceramic plate 4 with double-side adhesive tape to define on the plate 4 recesses (punched holes) 7 for receiving wafers in place. The substrate laminate 5*ab* was fitted in the recess 7 to which water was applied whereby the substrate 5*b* side was held to the plate 4 by the surface tension of water. In this state, the plate 4 was placed on a platen 1 such that the surface to be polished was in contiguous contact with an abrasive cloth 2. Then a drive shaft 8 was slowly moved down until it came in contact with the plate 4. While abrasives of colloidal silica were fed onto the abrasive cloth 2, the shaft 8 was further moved down to apply some pressure and rotated slowly. The subsequent rotation at the predetermined rotational speed under the predetermined pressure achieved mirror polishing.

After the completion of mirror polishing, the substrate laminate 5*ab* was taken out of the recess 7 in the ceramic plate 4 and separated through heat treatment into two wafers, wafer (product substrate) 5*a* and support substrate 5*b*. The wafers were ultrasonic cleaned at a certain frequency in a selected chemical solution for removing the abrasives of colloidal silica, particles and wax from the wafer surface.

After cleaning, the thickness of these wafers, wafer (product substrate) 5*a* and support substrate 5*b* was measured by a probe thickness gauge, finding that the wafer (product substrate) 5*a* was finished to a thickness of 90-100 μm, and the thickness of support substrate 5*b* remained unchanged from before charging on the polishing apparatus. The back surfaces of these wafers, wafer (product substrate) 5*a* and support substrate 5*b* were visually observed under fluorescent lamps, finding no scratches. In the subsequent batch, the wafer used as the support substrate 5*b*, having no scratches on the back surface, was made wafer (product substrate) and mirror polished similarly.

By repeating the above-described procedure, 100 wafers were polished. The wafers (product substrates) 5*a* were measured for flatness, finding a total thickness variation (TTV) of 0.85 to 2.53 μm and a local thickness variation maximum ($LTV_{max}$) of 0.24 to 0.41 μm at 5 mm×5 mm site. No breakage occurred in the wafers during the single-side polishing operation, but breakage occurred in some wafers when the substrate laminate was separated into two wafers after the mirror polishing. The manufacturing yield was 97%.

Example 2

This example relates to a lithium tantalate ($LiTaO_3$) single crystal wafer having a diameter of 100 mm (4 inches). A single crystal ingot was grown by Czochralski method and sliced into wafers using a wire saw. The wafers as sliced were lapped on a double-side lapping machine with appropriate abrasives (loose abrasive grains) to a desired thickness and until the front and back surfaces reached the predetermined roughness state.

Then two wafers lapped as above (having front and back surfaces roughened) were laminated together, with their front surfaces (identical polarized surfaces) inside, using a wax Skyliquid TW-2511 (Nikka Seiko Co., Ltd.). Although a heat treatment is involved in the lamination step, this lamination ensures that the warpage of two wafers is offset because two wafers of the same material develop thermal expansion behavior in opposite directions. The laminate was ready for the subsequent lapping step.

Using a double-side lapping machine and adequate abrasives (loose abrasive grains), the substrate laminate was lapped on the double sides to the desired thickness.

After the completion of double-side lapping, the substrate laminate 5*ab* was separated through heat treatment into two wafers. The wafers were ultrasonic cleaned in a selected chemical solution for removing the abrasives, particles and wax from the wafer surface.

After cleaning, the thickness of these wafers was measured by a probe thickness gauge, finding that the wafers were finished to a thickness of 120-130 μm, which was appropriate to work on the single-side polishing apparatus.

With the above results borne in mind, there were furnished a wafer (product substrate) 5*a* which was twice lapped to a thickness of 120-130 μm as described above, and a support substrate 5*b* which was obtained by double-side lapping a sliced wafer to the desired thickness. These two wafers were laminated together, with their back surfaces (identical polarized surfaces) inside, using a wax Skyliquid TW-2511 (Nikka Seiko Co., Ltd.). Although a heat treatment is involved in the lamination step, this lamination ensures that the warpage of two wafers is offset because two wafers of the same material develop thermal expansion behavior in opposite directions. The laminate was ready for the subsequent polishing step.

Then the substrate laminate 5*ab* was mirror polished using a single-side polishing apparatus as shown in FIG. 1. Specifically, a template 6 of glass-reinforced epoxy resin having holes (diameter 100.8 mm) punched out was secured to a ceramic plate 4 with double-side adhesive tape to define on the plate 4 recesses (punched holes) 7 for receiving wafers in place. The substrate laminate 5*ab* was fitted in the recess 7 to which water was applied whereby the substrate 5*b* side was held to the plate 4 by the surface tension of water. In this state, the plate 4 was placed on a platen 1 such that the surface to be polished was in contiguous contact with an abrasive cloth 2. Then a drive shaft 8 was slowly moved down until it came in contact with the plate 4. While abrasives of colloidal silica were fed onto the abrasive cloth 2, the shaft 8 was further moved down to apply some pressure and rotated slowly. The subsequent rotation at the predetermined rotational speed under the predetermined pressure achieved mirror polishing.

After the completion of mirror polishing, the substrate laminate 5*ab* was taken out of the recess 7 in the ceramic plate 4 and separated through heat treatment into two wafers, wafer (product substrate) 5*a* and support substrate 5*b*. The wafers were ultrasonic cleaned at a certain frequency in a selected chemical solution for removing the abrasives of colloidal silica, particles and wax from the wafer surface.

After cleaning, the thickness of these wafers, wafer (product substrate) 5*a* and support substrate 5*b* was measured by a probe thickness gauge, finding that the wafer (product substrate) 5*a* was finished to a thickness of 90-100 μm, and the thickness of support substrate 5*b* remained unchanged from before charging on the polishing apparatus. The back surfaces of these wafers, wafer (product substrate) 5*a* and support substrate 5*b* were visually observed under fluorescent lamps, finding no scratches. Since the wafer used as the support substrate 5*b* had no scratches on the back surface, but a substantial thickness, it was reused as a support substrate in the subsequent batch.

By repeating the above-described procedure, 100 wafers were polished. The wafers (product substrates) 5*a* were measured for flatness, finding a total thickness variation (TTV) of 0.76 to 2.85 μm and a local thickness variation maximum ($LTV_{max}$) of 0.22 to 0.45 μm at 5 mm×5 mm site. No breakage occurred in the wafers during the single-side polishing operation, and no breakage occurred in the wafers when the substrate laminate was separated into two wafers after the mirror polishing. The manufacturing yield was thus 100%.

Example 3

This example relates to a lithium tantalate ($LiTaO_3$) single crystal wafer having a diameter of 100 mm (4 inches). A single crystal ingot was grown by Czochralski method and sliced into wafers using a wire saw. The wafers as sliced were lapped on a double-side lapping machine with appropriate abrasives (loose abrasive grains) to a desired thickness and until the front and back surfaces reached the predetermined roughness state.

Then two wafers lapped as above (having front and back surfaces roughened) were laminated together, with their back surfaces (identical polarized surfaces) inside, using a wax Skyliquid TW-2511 (Nikka Seiko Co., Ltd.). Although a heat treatment is involved in the lamination step, this lamination ensures that the warpage of two wafers is offset because two wafers of the same material develop thermal expansion behavior in opposite directions. The laminate was ready for the subsequent polishing step.

Then the substrate laminate 5*ab* was mirror polished using a double-side polishing apparatus as shown in FIG. 2. Specifically, the substrate laminate 5*ab* was fitted in a hole (diameter 100.8 mm) of a polishing carrier 9. The carrier 9 having the substrate laminate 5*ab* received therein was disposed between a pair of lower and upper polishing platens 1 and 1' such that the surfaces to be polished were in contiguous contact with the abrasive cloths 2 and 2'. The lower and upper polishing platens 1 and 1' were then moved closer to apply a predetermined pressure. While abrasives of colloidal silica were fed to between the abrasive cloths 2 and 2', the platens 1 and 1' were rotated relatively. The polishing carrier 9 having the substrate laminate 5*ab* received therein was given planetary motion, thereby mirror polishing the laminate.

After the completion of mirror polishing, the substrate laminate 5*ab* was taken out of the hole 10 in the polishing carrier 9 and separated through heat treatment into two wafers, wafer (product substrate) 5*a* and support substrate 5*b*. The wafers were ultrasonic cleaned at a certain frequency in a selected chemical solution for removing the abrasives of colloidal silica, particles and wax from the wafer surface.

After cleaning, the thickness of these wafers, wafer (product substrate) 5*a* and support substrate 5*b* was measured by a probe thickness gauge, finding that both wafer (product substrate) 5*a* and support substrate 5*b* were finished to a thickness of 90-100 μm. The back surfaces of these wafers, wafer (product substrate) 5*a* and support substrate 5*b* were visually observed under fluorescent lamps, finding no scratches. It is noted that since the wafer used as the support substrate 5*b* had been finished to a quality level comparable to the wafer (product substrate) 5*a*, it was equally handled as a product substrate.

By repeating the above-described procedure, 200 wafers were polished. The wafers (product substrates) 5*a* were measured for flatness, finding a total thickness variation (TTV) of 0.72 to 2.02 μm and a local thickness variation maximum ($LTV_{max}$) of 0.18 to 0.37 μm at 5 mm×5 mm site. No breakage occurred in the wafers during the double-side polishing operation, but breakage occurred in some wafers when the substrate laminate was separated into two wafers after the mirror polishing. The manufacturing yield was 98%.

Example 4

This example relates to a lithium tantalate ($LiTaO_3$) single crystal wafer having a diameter of 100 mm (4 inches). A single crystal ingot was grown by Czochralski method and sliced into wafers using a wire saw. The wafers as sliced were lapped on a double-side lapping machine with appropriate abrasives (loose abrasive grains) to a desired thickness and until the front and back surfaces reached the predetermined roughness state.

Then two wafers lapped as above (having front and back surfaces roughened) were laminated together, with their front surfaces (identical polarized surfaces) inside, using a wax Skyliquid TW-2511 (Nikka Seiko Co., Ltd.). Although a heat treatment is involved in the lamination step, this lamination ensures that the warpage of two wafers is offset because two wafers of the same material develop thermal expansion behavior in opposite directions. The laminate was ready for the subsequent lapping step.

Using a double-side lapping machine and adequate abrasives (loose abrasive grains), the substrate laminate was lapped on the double sides to the desired thickness.

After the completion of double-side lapping, the substrate laminate 5*ab* was separated through heat treatment into two wafers. The wafers were ultrasonic cleaned in a selected chemical solution for removing the abrasives, particles and wax from the wafer surface.

After cleaning, the thickness of these wafers was measured by a probe thickness gauge, finding that the wafers were finished to a thickness of 120-130 μm, which was appropriate to work on the double-side polishing apparatus.

With the above results borne in mind, there were furnished a wafer (product substrate) 5*a* and a support substrate 5*b* which were twice lapped to a thickness of 120-130 μm as described above. These two wafers were laminated together, with their back surfaces (identical polarized surfaces) inside, using a wax Skyliquid TW-2511 (Nikka Seiko Co., Ltd.). Although a heat treatment is involved in the lamination step, this lamination ensures that the warpage of two wafers is offset because two wafers of the same material develop thermal expansion behavior in opposite directions. The laminate was ready for the subsequent polishing step.

Then the substrate laminate 5*ab* was mirror polished using a double-side polishing apparatus as shown in FIG. 2. Specifically, the substrate laminate 5*ab* was fitted in a hole (diameter 100.8 mm) of a polishing carrier 9. The carrier 9 having the substrate laminate 5*ab* received therein was disposed between a pair of lower and upper polishing platens 1 and 1' such that the surfaces to be polished were in contiguous contact with the abrasive cloths 2 and 2'. The lower and upper polishing platens 1 and 1' were then moved closer to apply a predetermined pressure. While abrasives of colloidal silica were fed to between the abrasive cloths 2 and 2', the platens 1 and 1' were rotated relatively. The polishing carrier 9 having the substrate laminate 5*ab* received therein was given planetary motion, thereby mirror polishing the laminate.

After the completion of mirror polishing, the substrate laminate 5*ab* was taken out of the hole 10 in the carrier 9 and separated through heat treatment into two wafers, wafer (product substrate) 5*a* and support substrate 5*b*. The wafers were ultrasonic cleaned at a certain frequency in a selected chemical solution for removing the abrasives of colloidal silica, particles and wax from the wafer surface.

After cleaning, the thickness of these wafers, wafer (product substrate) 5*a* and support substrate 5*b* was measured by a probe thickness gauge, finding that both wafer (product substrate) 5*a* and support substrate 5*b* were finished to a thickness of 90-100 μm. The back surfaces of these wafers, wafer (product substrate) 5*a* and support substrate 5*b* were visually observed under fluorescent lamps, finding no scratches. It is noted that since the wafer used as the support substrate 5*b* had been finished to a quality level comparable to the wafer (product substrate) 5*a*, it was equally handled as a product substrate.

By repeating the above-described procedure, 200 wafers were polished. The wafers (product substrates) 5*a* were measured for flatness, finding a total thickness variation (TTV) of 0.75 to 2.66 μm and a local thickness variation maximum ($LTV_{max}$) of 0.20 to 0.39 μm at 5 mm×5 mm site. No breakage occurred in the wafers during the single-side polishing operation, but breakage occurred in some wafers when the substrate laminate was separated into two wafers after the mirror polishing. The manufacturing yield was 97%.

Comparative Example 1

This example relates to a lithium tantalate ($LiTaO_3$) single crystal wafer having a diameter of 100 mm (4 inches). A single crystal ingot was grown by Czochralski method and sliced into wafers using a wire saw. The wafers as sliced were lapped on a double-side lapping machine with appropriate abrasives (loose abrasive grains) to a desired thickness and until the front and back surfaces reached the predetermined roughness state.

Then a wafer lapped as above (having front and back surfaces roughened) was mirror polished using a single-side polishing apparatus as shown in FIG. 3. Specifically, a template 6 of glass-reinforced epoxy resin having holes punched out was secured to a ceramic plate 4 with double-side adhesive tape to define on the plate 4 recesses (punched holes) 7 for receiving wafers in place. The wafer as lapped (having front and back surfaces roughened) was suction gripped in the recess 7 via a back pad of polyurethane foam having a thickness of 0.4 mm. In this state, the plate 4 was placed on a platen 1 such that the surface to be polished was in contiguous contact with an abrasive cloth 2. Then a drive shaft 8 was slowly moved down until it came in contact with the plate 4. While abrasives of colloidal silica were fed onto the abrasive cloth 2, the shaft 8 was further moved down to apply some pressure and rotated slowly. The subsequent rotation at the predetermined rotational speed under the predetermined pressure achieved mirror polishing.

After the completion of mirror polishing, the wafer was taken out of the recess 7 in the ceramic plate 4. The wafer was ultrasonic cleaned at a certain frequency in a selected chemical solution for removing the abrasives of colloidal silica, particles and wax from the wafer surface.

After cleaning, the thickness of the wafer was measured by a probe thickness gauge, finding that the wafer was finished to a thickness of 90-100 μm. The back surface of the wafers was visually observed under fluorescent lamps, finding no scratches.

By repeating the above-described procedure, 100 wafers were polished. The wafers (product substrates) 5*a* were measured for flatness, finding a total thickness variation (TTV) of 3.24 to 4.07 μm and a local thickness variation maximum ($LTV_{max}$) of 1.86 to 2.53 μm at 5 mm×5 mm site. Many wafers popped out of the hole and thus broke during the single-side polishing operation. Also breakage occurred in many wafers when they were separated from the back pad after the mirror polishing. The manufacturing yield was 23%.

Comparative Example 2

This example relates to a lithium tantalate ($LiTaO_3$) single crystal wafer having a diameter of 100 mm (4 inches). A single crystal ingot was grown by Czochralski method and sliced into wafers using a wire saw. The wafers as sliced were lapped on a double-side lapping machine with appropriate abrasives (loose abrasive grains) to a desired thickness and until the front and back surfaces reached the predetermined roughness state.

Then a wafer lapped as above (having front and back surfaces roughened) was mirror polished using a double-side polishing apparatus as shown in FIG. 2. Specifically, two wafers were laminated via an adsorbent plate. The sandwich was fitted in a hole 10 (diameter 100.8 mm) of a polishing carrier 9. The carrier 9 having the substrate sandwich received therein was disposed between a pair of lower and upper polishing platens 1 and 1' such that the surfaces to be polished were in contiguous contact with the abrasive cloths 2 and 2'. The lower and upper polishing platens 1 and 1' were then moved closer to apply a predetermined pressure. While abrasives of colloidal silica were fed to between the abrasive cloths 2 and 2', the platens 1 and 1' were rotated relatively. The polishing carrier 9 having the substrate sandwich received therein was given planetary motion, thereby mirror polishing the laminate.

After the completion of mirror polishing, the sandwich was taken out of the hole 10 in the carrier 9. The wafers were ultrasonic cleaned at a certain frequency in a selected chemical solution for removing the abrasives of colloidal silica and particles from the wafer surface.

After cleaning, the thickness of the wafers was measured by a probe thickness gauge, finding that the wafers were finished to a thickness of 90-100 μm. The back surface of the wafers was visually observed under fluorescent lamps, finding scratches on the back surface of some wafers.

By repeating the above-described procedure, 200 wafers were polished. The wafers (product substrates) 5*a* were measured for flatness, finding a total thickness variation (TTV) of 0.88 to 2.23 μm and a local thickness variation maximum ($LTV_{max}$) of 0.20 to 0.41 μm at 5 mm×5 mm site. Many wafers popped out of the hole 10 in the carrier 9 and thus broke during the double-side polishing operation. Also breakage occurred in many wafers when they were separated after the mirror polishing. The manufacturing yield was 35%.

It is demonstrated that as compared with Comparative Examples, Examples are successful in manufacturing in high yields thin wafers having a thickness equal to or less than 100 μm. Such thin wafers can be produced in a consistent manner at an improved working accuracy such as high flatness or parallelism equivalent to that of the existing 350-μm thick wafers while maintaining their front and back surface states equivalent to those of the existing 350-μm thick wafers.

Although lithium tantalate wafers having a diameter of 100 mm (4 inches) are referred to in Examples, the invention is equally applicable-to piezoelectric oxide single crystal wafers of lithium tantalate, lithium niobate, quartz, lithium tetraborate, langasite and the like used in SAW filers or the like. The thickness and diameter of wafers are not particularly limited.

Although the invention is advantageously applied to piezoelectric oxide single crystal wafers, it is equally applicable to wafers of various materials including wafer substrates having only one surface mirror polished such as silicon wafers, compound semiconductor wafers, and synthetic quartz wafers.

Japanese Patent Application No. 2005-251026 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

The invention claimed is:

1. A method for polishing a wafer substrate, comprising the steps of providing a wafer substrate having a diameter of D mm and a support substrate having a diameter from D mm to D+2.5 mm and laminated to the wafer substrate, wherein the wafer substrate and the support substrate each are a piezoelectric oxide single crystal, disposing the wafer substrate and support substrate between an abrasive cloth on a polishing platen and a plate securing a template with a punched hole having a diameter from D mm to D+5 mm so that the wafer substrate and the support substrate are fitted within the punched hole of the template, the wafer substrate being positioned at the polishing platen side and the support substrate being positioned at the plate side, the wafer substrate and the support substrate being of the same material, relatively rotating the polishing platen and the plate for mirror polishing the abrasive cloth side surface of the wafer substrate with the abrasive cloth, and feeding a liquid onto the plate side surface of the support substrate so that the wafer substrate is held through the support substrate to the plate by the adsorption force of the liquid, while performing the mirror polishing.

2. The polishing method of claim 1, wherein the piezoelectric oxide single crystal is lithium tantalate.

3. The polishing method of claim 1, wherein the back surfaces of the wafer substrate and the support substrate are laminated together.

4. The polishing method of claim 3, wherein the wafer substrate and the support substrate are of the same piezoelectric oxide single crystal.

5. The polishing method of claim 4, wherein the piezoelectric oxide single crystal is lithium tantalate.

6. The polishing method of claim 1, wherein the wafer substrate has a thickness of up to 100 μm.

7. The polishing method of claim 5, wherein the lithium tantalate single crystal wafer has a thickness of up to 100 μm.

* * * * *